United States Patent [19]

Rose

[11] Patent Number: 4,782,734

[45] Date of Patent: Nov. 8, 1988

[54] KEYBOARD KEYS FOR LARGER HANDS

[76] Inventor: Erma L. Rose, 3300 Green Ridge Rd., NW., Roanoke, Va. 24019

[21] Appl. No.: 89,086

[22] Filed: Aug. 25, 1987

[51] Int. Cl.[4] ..... G10C 3/12

[52] U.S. Cl. ..... 84/423 R; 84/433

[58] Field of Search ..... 84/423, 428, 451, 433

[56] References Cited

U.S. PATENT DOCUMENTS

| | | | |
|---|---|---|---|
| 2,627,777 | 2/1953 | Robbins | 84/423 A |
| 2,706,926 | 4/1955 | Young | 84/451 |
| 2,885,921 | 5/1959 | Goldhammer | 84/423 R |
| 3,855,894 | 12/1974 | Thomas et al. | 84/423 A |

*Primary Examiner*—Lawrence R. Franklin

*Attorney, Agent, or Firm*—Richard C. Litman

[57] ABSTRACT

An improved keyboard includes the replacement or substitution of the original, conventional flat/sharp or black keys with a more narrower key having a width factor substantially within the range of 0.55 to 0.85 of the width of a standard or original black key such that the players having hands and/or fingers larger than normal may more easily reach the adjacent shank portion of the intermediate white keys.

2 Claims, 1 Drawing Sheet

KEYBOARD KEYS FOR LARGER HANDS

FIELD OF INVENTION

This device relates to keyboards for musical devices and specifically relates to an improved size and shape of the keys on a keyboard such that a person with large hands and/or fingers may more conveniently play the keyboard.

BACKGROUND OF THE INVENTION

Keyboards of various types of musical instruments such as organs and pianos have been constructed and played for centuries; however, only recently has the manufacturing technology and study of ergonomic standards made possible a variety of keyboards that are designed and built for people of different sizes.

Pianos, for example, have a standardized construction, which hasn't materially varied varied in the width and shape of the keys for hundreds of years.

The continued use of the standardized keyboard has resulted from the necessities made manifest by the limitations of economies of scale, (i.e., a given number of pianos are sold each year), and lastly, by the lack of ergonomic measurements. Ergonomics, or more so the lack of ergonomics, relates to a restricted development of alternative keyboards, which would establish; (1) a simplified method of learning how to play, and (2) the correct procedure of moving the fingers across the keyboard, and between the keys.

The present invention relates to keyboards, and to an alternative construction for the black, the sharp/flat keys, so that people with larger hands may play these instruments more skillfully and more enjoyably.

DESCRIPTION OF THE PRIOR ART

Various prior art disclose devices for accommodating the playing of pianos, and the like, as well as their apparatus and the method of their construction in general and are known and found to be exemplary of the U.S. prior art. They are:

| U.S. Pat. No. | Inventor |
|---|---|
| 717,645 | Wiehmayer |
| 572,550 | Clements-Kropp |
| 4,227,436 | Kryzanowsky |

U.S. Pat. No. 717,645, issued to Wiehmayer, discloses a keyboard for pianos and organs which is an improvement to the keyboard of all musical instruments. It discloses more accommodations for playing these instruments by using a more advantageous division of the keyboard.

U.S. Pat. No. 572,550, to Clement-Kropp, teaches a construction to make the keyboard and pedal more convenient and practical and more suitable for the natural construction of hands and fingers.

U.S. Pat. No. 4,227,436, issued to Kryzanowsky, discloses an improvement on existing keyboard of pianos, organs and other keyboard instruments providing two sets of keys, each having a widened main portion and a narrow extension.

These patents or known prior art uses teach and disclose various types of keyboard improvement devices of sorts and of various manufactures, and the like, as well as methods of their construction; but none of them, whether taken singly or in combination, disclose the specific details of the combination of the present invention in such a way as to bear upon the claims as appended hereto.

SUMMARY OF THE INVENTION

A primary object, advantage, and feature of the invention is to provide a novel and more convenient construction for the black keys of the piano, organ or the like, such that players with larger fingers than normal may reach therebetween more easily.

This, together with other objects and advantages of the invention, reside in the details of the process and the operation thereof, as is more fully hereinafter described and claimed. References are made to drawings forming a part hereof, wherein like numerals refer to like parts throughout.

DESCRIPTION OF THE PREFERRED EMBODIMENT

Figure 1:
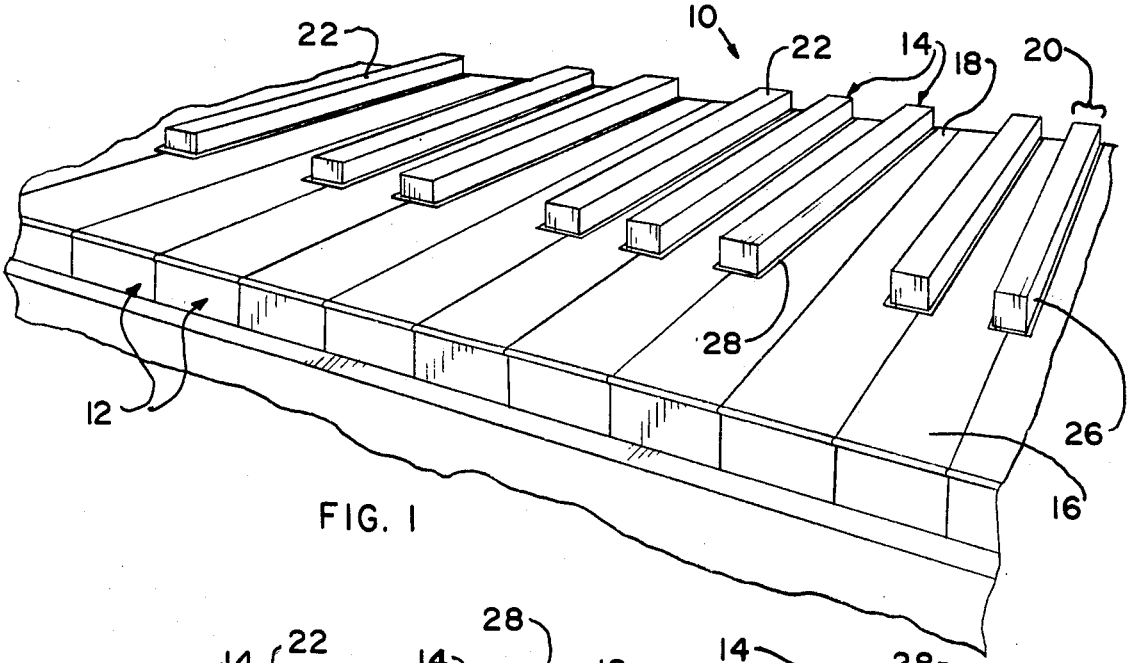
FIG. 1 is a partial perspective view of a keyboard illustrating the alternate black and white keys according to the present invention.
Figure 2:
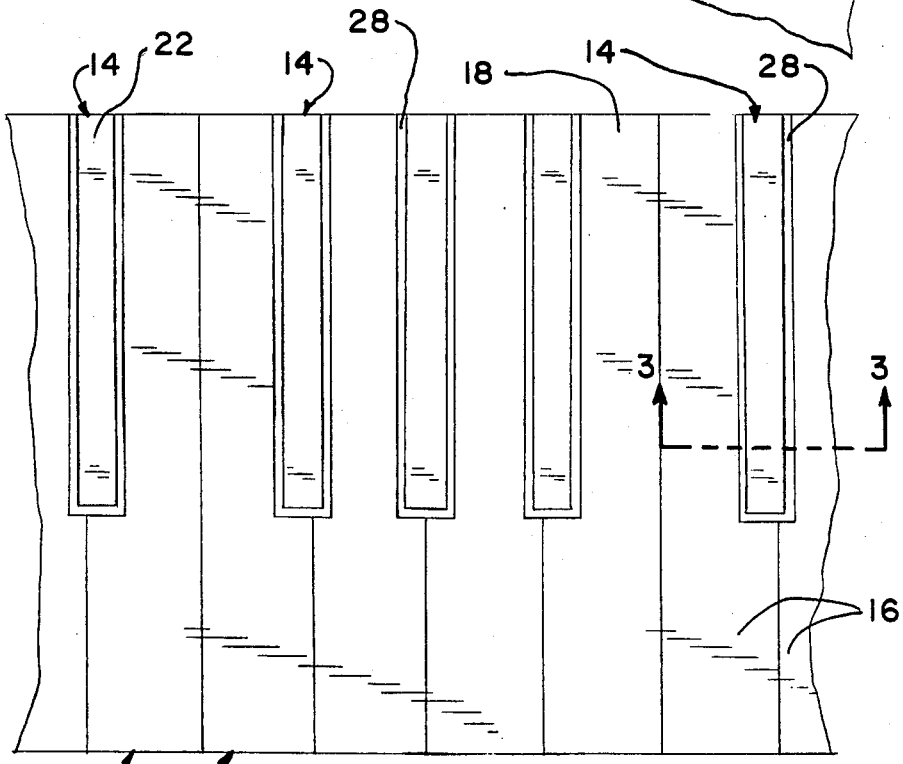
FIG. 2 is a top plan view of the keys shown in FIG. 1.

Referring now to the drawings, FIGS. 1 and 2 will be seen to illustrate a keyboard 10 having a plurality of laterally adjacent white and black or sharp/flat keys 12, 14 respectively. These keys are generally disposed in a conventional alternate arrangement although the construction and relationship between the two different types of keys is distinctive as will be apparent hereinafter.

The white keys 12 each include a full-width front portion 16 joined to a narrower, rearmost shank portion 18. This much may be of conventional construction. The shorter black keys 14, on the other hand, are of a modified construction. In a normal keyboard, the width 20 of the black keys 14 is at least as great as the width of the adjacent shank portions 18 of the white keys. This configuration often leads to a less than ideal arrangement when the keyboard is used by a person whose hands, and more particularly, whose fingers, are larger than normal. Many persons have fingers of a width greater than that of the usual black key width and thus it will follow that an extra effort would be required for such a user to strike the shank portions 18 of the white keys 12 without disturbing the laterally adjacent black keys 14.

Figure 3:
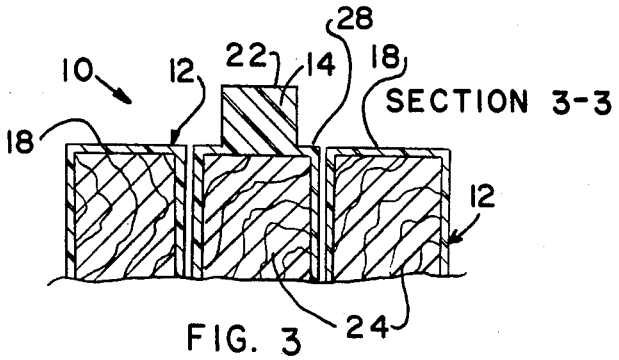
FIG. 3 is a cross sectional view taken along the line 3—3 in FIG. 2.

By the present invention, the black keys 14 are modified to provide a noticeably reduced width 20, as compared to the socalled standard keyboard and as compared to the adjacent white key shank portions 18. This relationship is shown most clearly in the enlarged cross-sectional view of FIG. 3 wherein it will be seen that the black key top surface 22 is narrower than both the underlying keybase structure 24 and the adjacent white key shank portions 18. Experiments have shown that the width 20 of the black keys may range between 0.55–0.85 of that of conventional black keys with the result that improved ease of playing will be experienced by persons with larger than normal fingers or hands.

With the above construction it will be apparent that a player with larger than normal hands and/or fingers may readily depress any of the white key shank portions 18 without interference from the modified, adjacent black keys 14.

A feature of the instant construction is that it is not necessary to modify the underlying or keybase structure to provide the proposed improvement as it is the upstanding body of the black keys that is altered. In the preferred embodiment, the black keys have a rectangular cross section with vertical side walls 26 intersecting an enlarged key bottom 28 comprising lateral flanges substantially coplanar with the adjacent, intermediate white key shanks 18, as shown in the drawings. This key bottom 28, although of minimal vertical thickness, may be of conventional length and width dimensions since it is the upstanding portion of the black keys that provides the improved operation of the invention.

Alternatively, the black keys 14 may be trapezoidal in cross-section, that is, provided with downwardly and outwardly inclined side walls (not shown) although this arrangement is least preferred.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications, and equivalents which may be resorted to, fall within the scope of the invention.

What is claimed is:

1. A keyboard for a piano or the like comprising;

a plurality of adjacent white and black keys each having a planar top surface, said white keys having a full-width front portion joined to a narrower rearmost shank portion, said black keys of a shorter length and disposed intermediate said white key shank portions, vertically disposed side walls on said black keys, said white and black keys each including a keybase and defining a minimal spacing therebetween, said black keys each having akey bottom comprising a horizontally disposed flange atop its respective keybase and extending laterally from said black key side walls, said black key flanges disposed co-planar with said white key shank portions with said keys in a normal at-rest position, and said black key top surfaces each defining a width substantially less than that of said top surfaces of said white key shank portions whereby, an enlarged lateral spacing is provided between adjacent ones of said black keys to facilitate striking of said white key shank portions therebetween without requiring modification of said key base.

2. An improved keyboard according to claim 1 wherein, the width of said black keys is in the range between 0.55 and 0.85 of the width of said white key shank portions.

* * * * *